US008020501B2

(12) United States Patent
Kawaguchi et al.

(10) Patent No.: US 8,020,501 B2
(45) Date of Patent: Sep. 20, 2011

(54) SEWING MACHINE

(75) Inventors: Yasuhiko Kawaguchi, Nagoya (JP); Hiroshi Yamasaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 321 days.

(21) Appl. No.: 12/453,919

(22) Filed: May 27, 2009

(65) Prior Publication Data

US 2009/0301369 A1 Dec. 10, 2009

(30) Foreign Application Priority Data

Jun. 5, 2008 (JP) ..... 2008-148002

(51) Int. Cl.
*D05B 69/36* (2006.01)

(52) U.S. Cl. ..... 112/274

(58) Field of Classification Search ..... 112/274, 112/275, 277, 281, 221, 235, 244, 245, 246, 112/314, 324

See application file for complete search history.

(56) References Cited

U.S. PATENT DOCUMENTS

| | | | |
|---|---|---|---|
| 5,474,005 | A | 12/1995 | Yamauchi et al. |
| 5,562,059 | A | 10/1996 | Yamauchi et al. |
| 5,571,240 | A | 11/1996 | Yamauchi et al. |
| 5,653,186 | A | 8/1997 | Yamauchi et al. |
| 7,299,757 | B2 | 11/2007 | Niizeki et al. |
| 2007/0227419 | A1 | 10/2007 | Hirose |

FOREIGN PATENT DOCUMENTS

| | | |
|---|---|---|
| JP | A-56-15787 | 2/1981 |
| JP | A-56-20490 | 2/1981 |
| JP | A-62-120883 | 6/1987 |
| JP | A-62-207492 | 9/1987 |
| JP | A-63-275385 | 11/1988 |
| JP | A-64-020891 | 1/1989 |
| JP | A-4-343751 | 11/1992 |
| JP | A-6-190180 | 7/1994 |
| JP | A-2000-153088 | 6/2000 |
| JP | A-2006-246087 | 12/2006 |
| JP | A-2007-244721 | 9/2007 |

OTHER PUBLICATIONS

Japanese Office Action issued in Japanese Patent Application No. 2008-148002 dated Jul. 27, 2010 (with Translation).

*Primary Examiner* — Tejash Patel
(74) *Attorney, Agent, or Firm* — Oliff & Berridge, PLC

(57) ABSTRACT

A controller of a sewing machine configured to execute a pre-positioning operation including controlling a needle bar driving mechanism, based on a thickness of a workpiece cloth detected by a thickness detection mechanism and a vertical position of a needle bar detected by a needle bar position detection mechanism, to stop a needle bar at a preset position immediately before a tip of a sewing needle pierces the workpiece cloth, controlling a pressure adjustment mechanism to adjust a pressure of a presser foot at a predetermined pressure that allows movement of the workpiece cloth, and controlling a feed dog switching mechanism to switch a feed dog to an inoperative state.

5 Claims, 10 Drawing Sheets

SEWING MACHINE

CROSS-REFERENCE TO RELATED APPLICATIONS

This application is based upon and claims the benefit of priority from the prior Japanese Patent Application 2008-148002, filed on Jun. 5, 2008, the entire contents of which are incorporated herein by reference.

FIELD

The present disclosure relates to a sewing machine allowing a user to make adjustments in workpiece cloth positioning relative to a sewing needle with greater ease at timings, for instance, prior to starting a sewing operation.

BACKGROUND

Workpiece cloth positioning is typically carried out prior to a sewing operation by positioning a workpiece cloth relative to a sewing needle so that the sewing needle strikes through the intended start point of the subsequent stitches being formed. When the sewing machine is standing by for execution of a sewing operation, a needle bar to which the sewing needle is attached generally assumes an elevated position where the tip of the sewing needle is lifted away from the workpiece cloth. Such arrangement is obviously unsuitable for precise workpiece cloth positioning, and thus, the user was required go through a troublesome task of lowering the needle bar to proximate the tip of the sewing needle to the upper surface of the workpiece cloth as much as possible through the user's manual rotation of a pulley.

One possible solution to such inconvenience is proposed in a sewing machine disclosed in JP S62-207492 A, in which the sewing needle is lowered from the elevated position by the user's depression of a switch until it is stopped at a preset position immediately before contacting the workpiece cloth. The above configuration allows smooth and error-free workpiece cloth positioning in starting off the sewing operation on the workpiece cloth (establishing the first needle drop).

In positioning the workpiece cloth relative to the sewing needle, the user is allowed to move the workpiece freely by keeping a presser foot elevated. However when there is absolutely no constraint in the movement of the workpiece cloth, the user is required to provide some extent of manual pressure to prevent displacement of the workpiece cloth. In other words, the workpiece cloth being unlimited in its movement will subject itself to frequent displacement, which in turn renders workpiece cloth adjustment more troublesome for the user.

Further, since a feed dog protruding and retracting from a needle plate for feeding the workpiece cloth is moved in synchronism with the vertical movement of the needle bar, the feed dog is unwontedly elevated above the needle plate when the sewing needle is stopped at a position above the needle plate. Thus, during workpiece positioning, smooth workpiece cloth transfer may not be possible depending upon the material of the workpiece cloth if the material is prone to be seized by the elevated feed dog.

SUMMARY

One object of the present disclosure is to provide a sewing machine allowing easy and reliable workpiece positioning at the start of a sewing operation without requiring any troublesome preparatory work on the part of the user such as needle bar adjustment through manual pulley operation.

In one aspect, a sewing machine of the present disclosure includes a needle bar; a sewing needle attached to a lower end of the needle bar; a needle bar driving mechanism that vertically moves the needle bar and that allows the needle bar to be stopped at a given position; a needle bar position detection mechanism that detects a vertical position of the needle bar; abed; a needle plate provided on the bed; a presser foot that presses a workpiece cloth against the needle plate; a pressure adjustment mechanism that adjusts a pressure exerted by the presser foot; a thickness detection mechanism that detects a thickness of the workpiece cloth; a feed dog that feeds the workpiece cloth; a feed dog switching mechanism that switches the feed dog between an operative state in which the feed dog is moved above and below the needle plate and an inoperative state in which the feed dog stays below the needle plate; a controller that controls the needle bar driving mechanism, the pressure adjustment mechanism, and the feed dog switching mechanism, wherein the controller is configured to be capable of executing a pre-positioning operation including: controlling the needle bar driving mechanism, based on the thickness of the workpiece cloth detected by the thickness detection mechanism and the vertical position of the needle bar detected by the needle bar position detection mechanism, to stop the needle bar at a preset position immediately before a tip of the sewing needle pierces the workpiece cloth, controlling the pressure adjustment mechanism to adjust the pressure of the presser foot at a predetermined pressure that allows movement of the workpiece cloth, and controlling the feed dog switching mechanism to switch the feed dog to the inoperative state.

When the controller executes the pre-positioning operation, the needle bar (sewing needle) stops at the preset position immediately before the tip of the sewing needle pierces the workpiece cloth. The user is thus, allowed to position the workpiece cloth prior to the sewing operation with ease. The preset position is determined based on the actual thickness of the workpiece cloth detected by the thickness detection mechanism, hence, the sewing needle can always be stopped at the preset position immediately before the sewing needle pierces the workpiece cloth regardless of whether workpiece cloth W is thick or thin.

Further, the pressure exerted by the pressure adjustment mechanism is controlled to the predetermined pressure that allows movement of the workpiece cloth. Since the workpiece cloth is not absolutely free to move but is pressed by the predetermined pressure allowing movement of some extent, the workpiece cloth can be prevented from being readily displaced. According to such configuration, the user is no longer required to provide a firm hold of the workpiece cloth, making the pre-positioning task much easier. Furthermore, since the feed dog switching mechanism places the feed dog in the inoperative state, the feed dog will not interfere with the workpiece cloth during workpiece positioning by the user and allow smooth movement of the workpiece cloth.

As a result, the user is no longer required to go through a troublesome task of manually rotating the pulley to move the needle bar to the position immediately before the sewing needle pierces the workpiece cloth while preventing the feed dog from interfering with the workpiece cloth during the user's positioning of the workpiece cloth and thus, advantageously allowing easy and reliable execution of positioning work.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One exemplary embodiment of the present disclosure will be described hereinafter with reference to the accompanying drawings.

Figure 1:
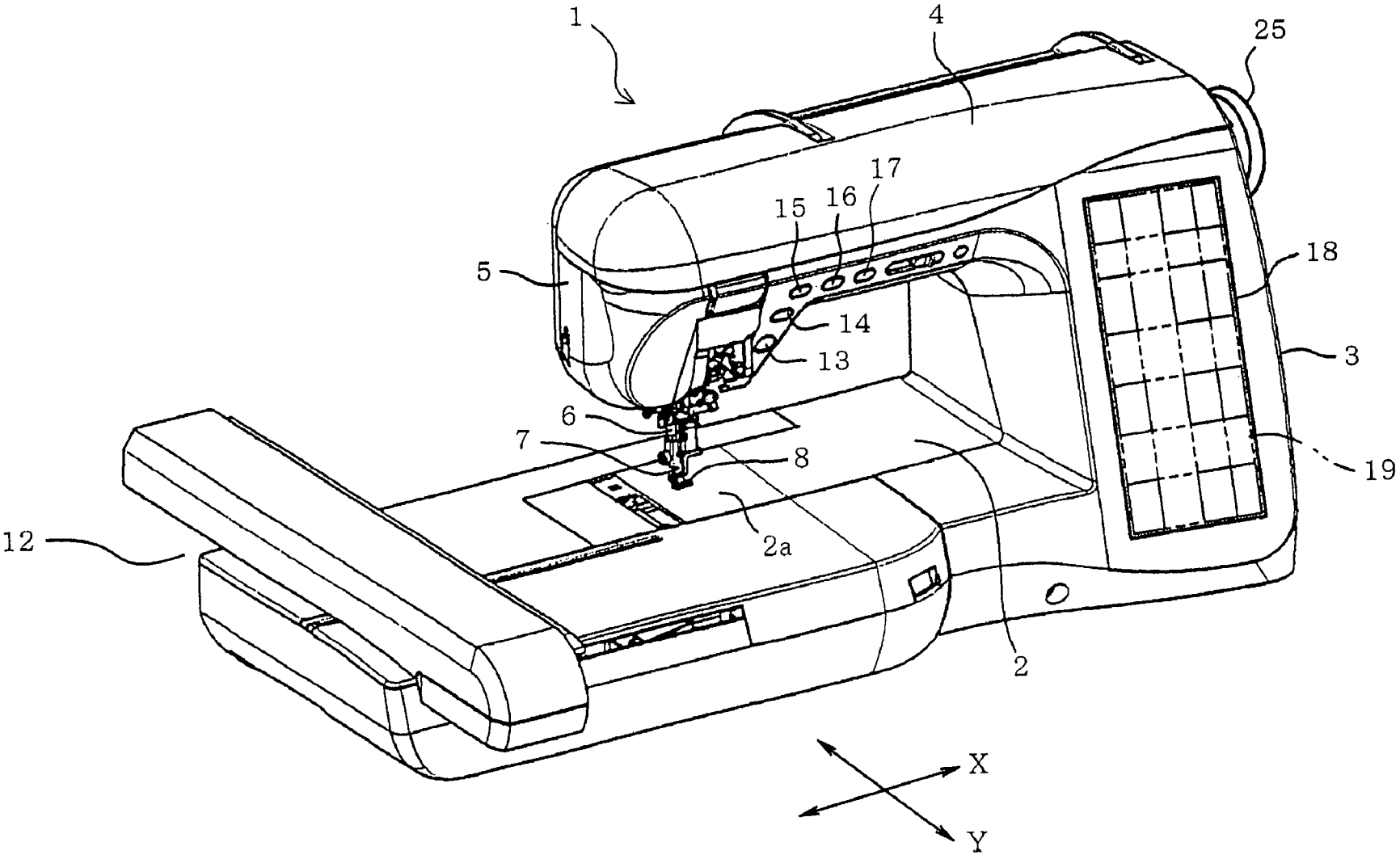
FIG. 1 is a perspective view of a main body of a sewing machine with an attachment of an embroidery machine according to one exemplary embodiment of the present disclosure.

FIG. 1 provides a perspective view of the overall configuration of a household electronic sewing machine with an embroidery machine attachment on its sewing machine bed for embroidering.

The sewing machine has a main body 1 integrally provided with a laterally (X-direction) extending sewing machine bed 2 (hereinafter referred to as bed 2), an upwardly extending pillar 3 standing on the right end of bed 2, and an arm 4 extending leftward over bed 2 from the upper end of pillar 3. The extreme end of arm 4 constitutes a head 5. For ease of explanation to follow, the direction to which the user or the operator positions him/herself relative to main body 1 is referred to as the front side, and the opposing direction, naturally as the rear side. The direction toward which pillar 3 is displaced from the center of arm 4 is referred to as the right side and the opposing direction, naturally, as the left side.

Figure 3:
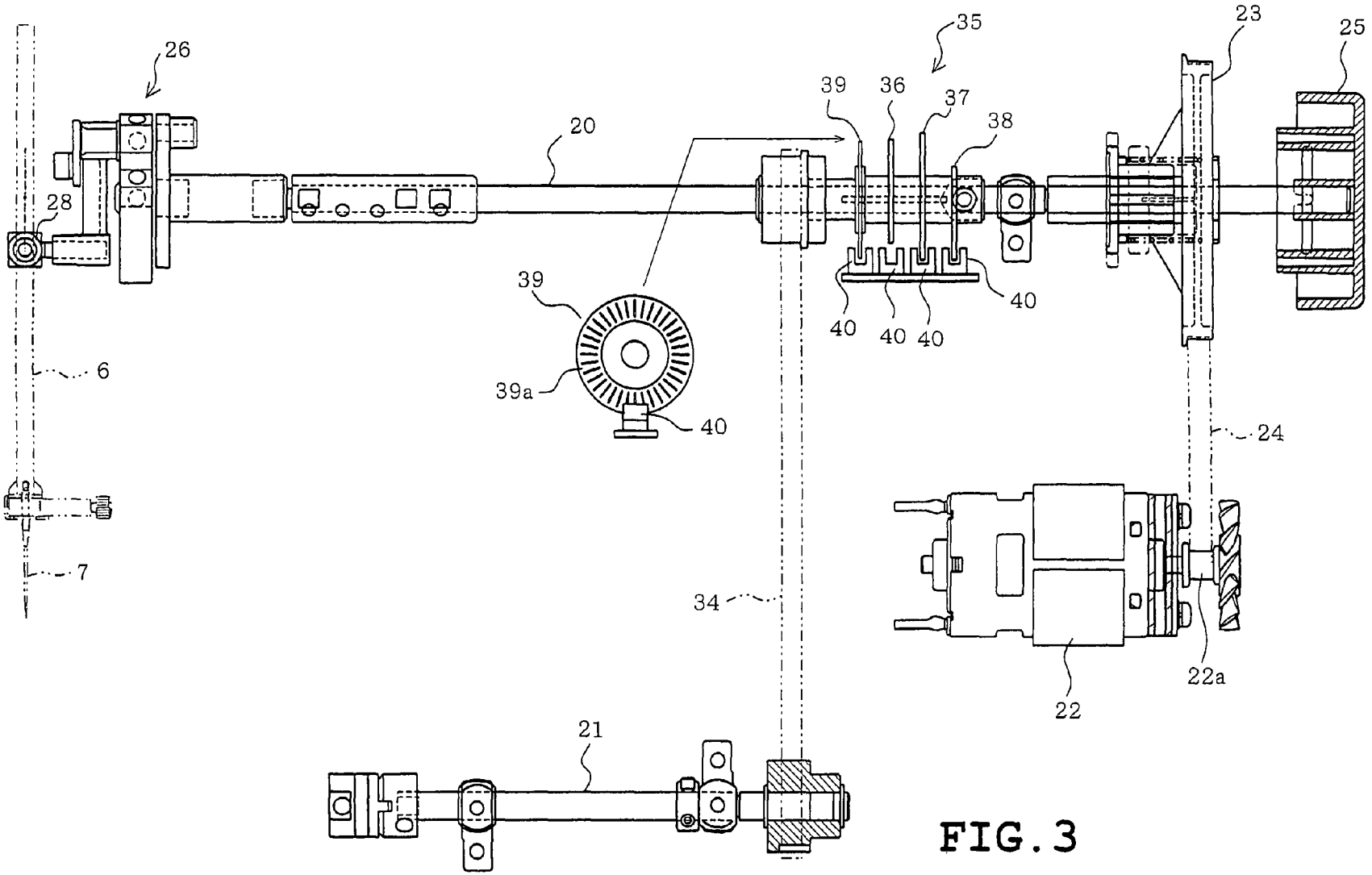
FIG. 3 depicts components such as a main shaft, a lower shaft, and a sewing machine motor being assembled into the main body.
Figure 4:
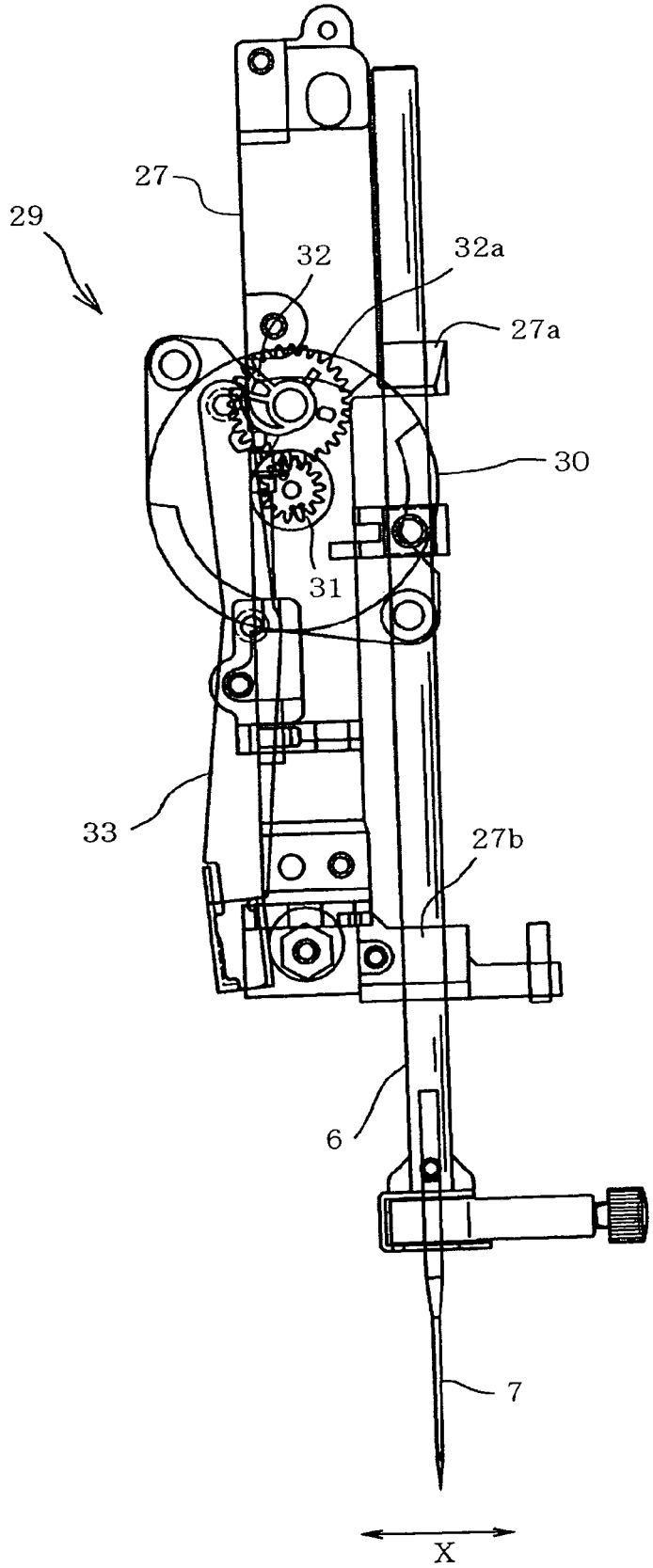
FIG. 4 is front view of a needle bar swinging mechanism.

As can be seen in FIGS. 3 and 4, head 5 provided at the end of arm 4 has a needle bar 6 configured vertically movably and laterally (X-direction) swingably. Needle bar 6 has a sewing needle 7 interchangeably attached on its lower end. Behind presser bar 6 extending out of the interior of head 5, a presser foot 8 is provided that is vertically moved by presser foot vertically moving mechanism 9 shown in FIGS. 5 and 6. Though not shown, in the proximity of needle bar 6 (sewing needle 7) a needle threader (not shown) known in the art is provided for threading a needle thread drawn from a thread spool to a needle eye (not shown) of sewing needle 7, head 5 is further provided with components such as a thread take-up driving mechanism that vertically moves a thread take-up (not shown) in synchronism with the vertical movement of needle bar 6, and a thread tension regulator that makes adjustments in thread tension of the needle thread.

Figure 7:
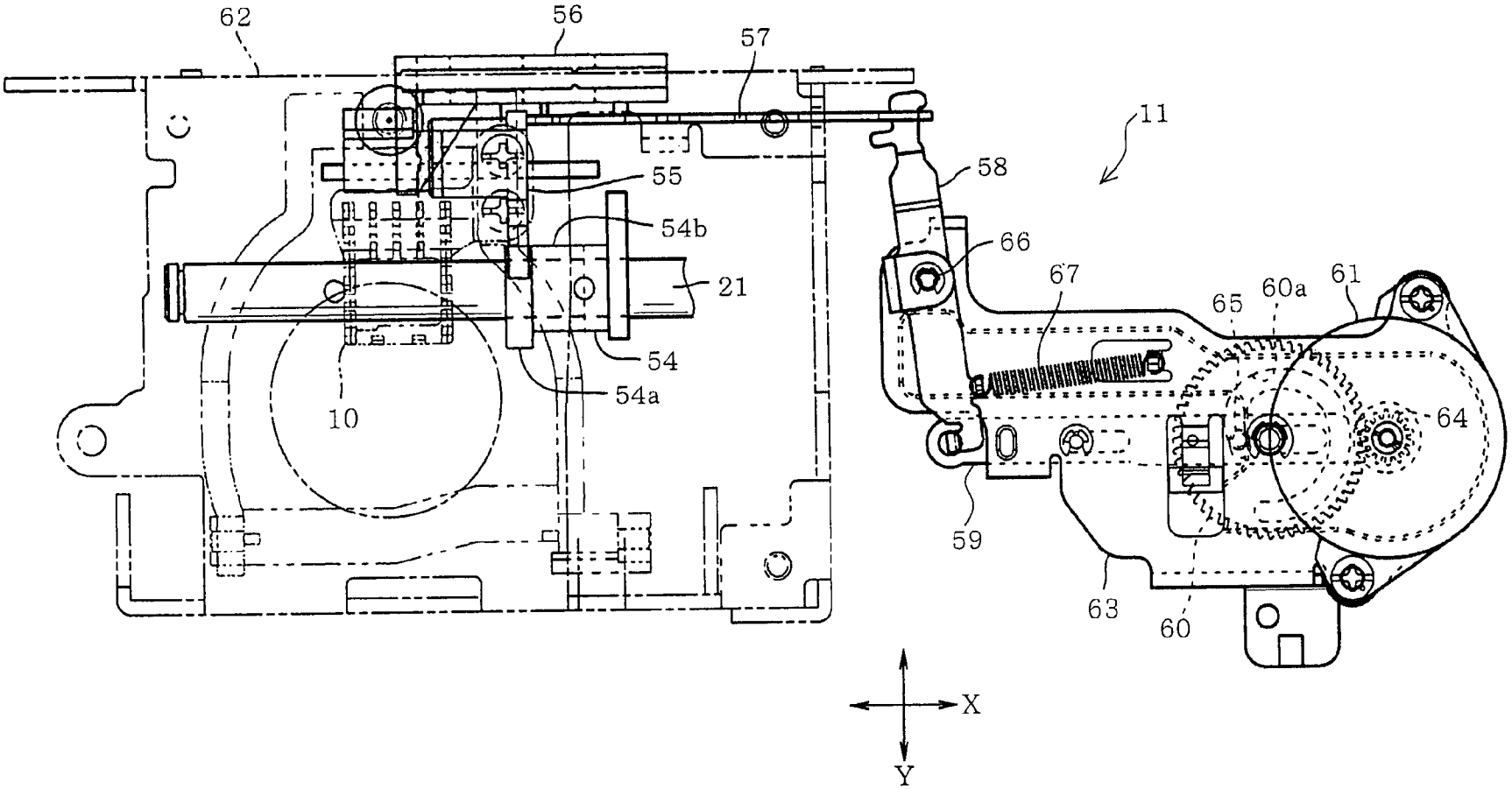
FIG. 7 is a plan view of a feed dog switching mechanism with a feed dog in an operative state.
Figure 8:
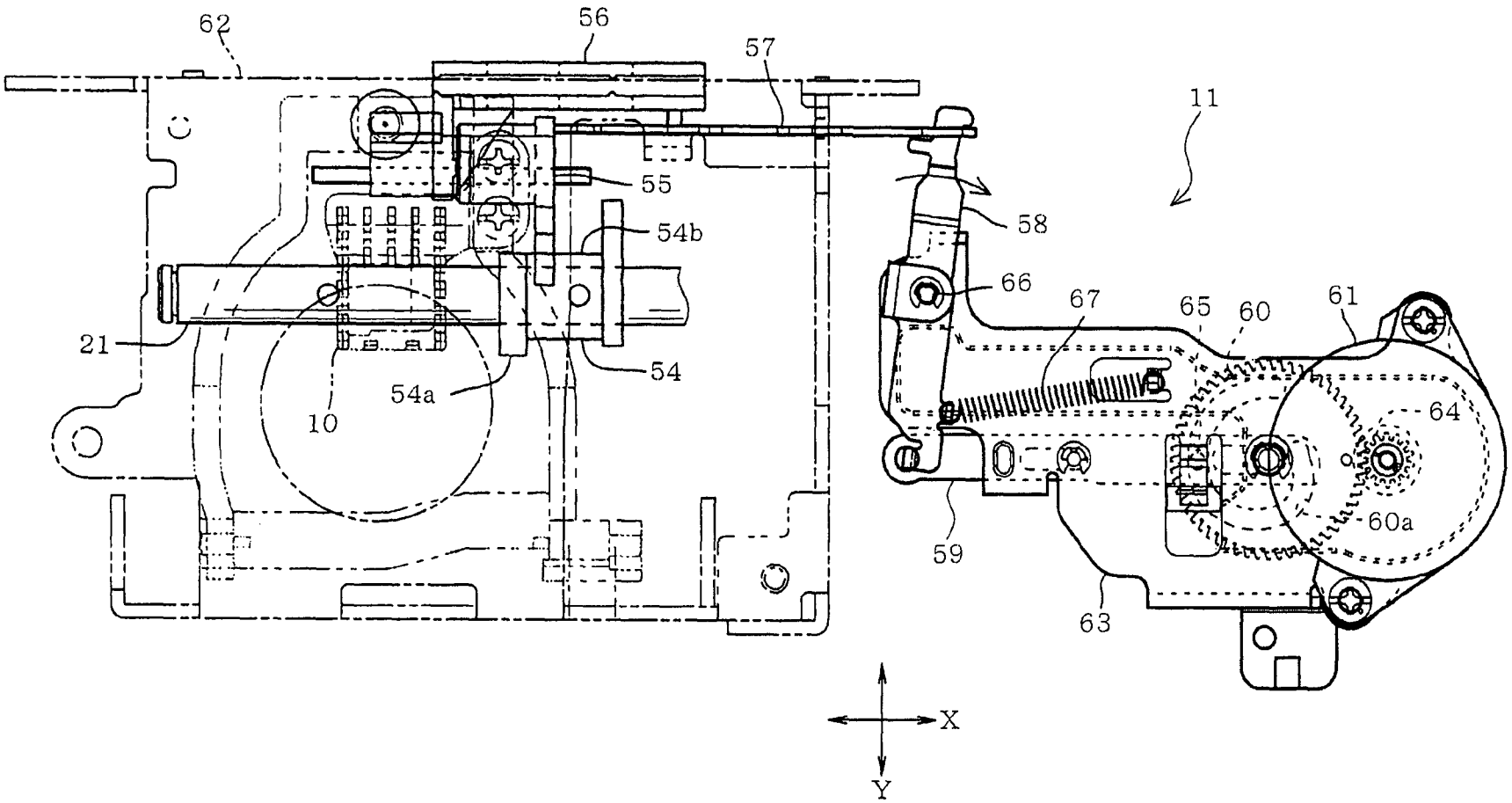
FIG. 8 is a plan view of the feed dog switching mechanism with the feed dog in an inoperative state.

Referring to FIG. 1, a needle plate 2*a* associated with needle bar 6 is provided on the upper surface of bed 2. Though not shown in detail, within bed 2, in other words, below needle plate 2*a*, components such as a shuttle mechanism not shown, a feed dog 10 shown in FIGS. 7 and 8, a feed dog driving mechanism not shown, and a feed dog switching mechanism 11 shown in FIGS. 7 and 8 are provided. The shuttle mechanism contains a bobbin thread bobbin and forms stitches on a workpiece cloth W (only shown in FIG. 9) in cooperation with sewing needle 7. Feed dog 10 longitudinally feeds workpiece cloth W and is driven longitudinally and vertically by the feed dog driving mechanism so as to be in synchronism with the vertical movement of needle bar 6. As later described, feed dog switching mechanism 11 switches feed dog 10 between an operative state in which feed dog is moved above and below needle plate 2*a* to feed workpiece cloth W and an inoperative state in which feed dog 10 stays lowered below the upper surface of needle plate 2*a*.

At the left end of bed 2, a free arm is provided for attachable/detachable attachment of a well known embroidery machine (embroidery frame transfer machine) 12. Embroidery machine 12 is attachably/detachably attached with an embroidery frame (not shown) that holds workpiece cloth W. Embroidery machine 12 comprises an embroidery frame transfer mechanism (not shown), an X-direction motor (not shown), and a Y-direction motor (not shown). The embroidery frame transfer mechanism transfers the embroidery frame freely in the X-direction (lateral direction) and the Y-direction (longitudinal direction) orthogonal to the X-direction in the space overlying bed 2 (needle plate 2*a*) and is driven by the X-direction motor and the Y-direction motor. The attachment of embroidery machine 12 triggers automatic mode setting to an embroidery sewing mode.

Though not shown, bed 2 may also allow attachable/detachable attachment of an auxiliary table instead of embroidery machine 12 for providing greater area of workpiece W placement. Examples of operations that can be performed with the auxiliary table attachment are normal and free motion sewing operations. In a normal sewing operation, utility stitches such as straight stitches and zigzag stitches may be formed while feeding workpiece cloth W with feed dog 10. In a free motion sewing operation, the user is allowed to manually move workpiece cloth W stitch by stitch in any given direction to form desired stitches on workpiece cloth W.

Figure 10:
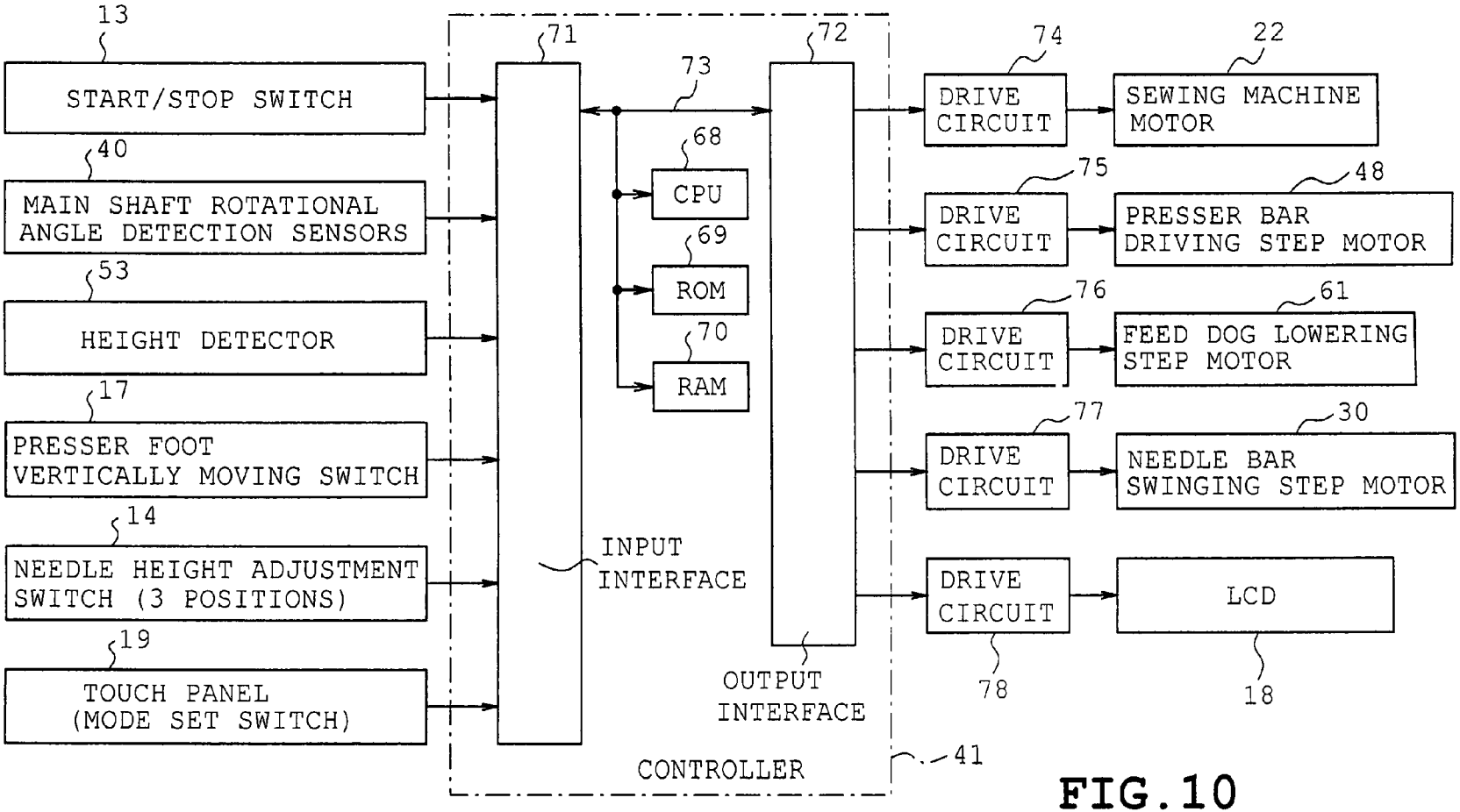
FIG. 10 is a block diagram schematically describing an electrical configuration of the sewing machine.

As can be seen in FIG. 1, key switches are provided on the front face of arm 4 for user operation. Examples of key switches are controls such as start/stop switch 13, a needle height adjustment switch 14, a back stitch switch 15, a thread cut switch 16, and a presser foot vertically moving switch 17. On the front face of pillar 3, a sizeable and vertically elongate liquid crystal display 18 (hereinafter simply referred as LCD 18) is provided for displaying various information in full color as required. LCD 18 has a touch panel 19 shown in FIG. 10 provided on its surface which is depressed by the user for stitch pattern selection and mode setting from the selection of normal, free motion, and embroidery mode, for example.

As shown in FIG. 3, arm 4 contains a laterally oriented main shaft 20 and a lower shaft 21 also laterally oriented as partially shown as well in FIGS. 7 and 8. FIG. 3 further shows a sewing machine motor 22 situated at the inner bottom portion of pillar 3. Sewing machine motor 22 has a motor pulley 22*a* provided on its output shaft. Similarly, main shaft 20 has a timing pulley 23 provided at its right end. Motor pulley 22*a* and timing pulley 23 have a timing belt 24 wound around them so that sewing machine motor 22, when driven, rotates main shaft 20 through timing belt 24 and timing pulley 23. Referring back to FIG. 1, a hand pulley 25 is provided at the right end of main shaft 20 to allow manual rotation of main shaft 20 by the user.

Provided inside head 5 is a known needle bar driving mechanism 26 which is connected to the left end of main shaft 20 and which converts rotary movement of main shaft 20 into vertical movement of needle bar 6 such that needle bar 6 is vertically reciprocated once as main shaft 20 is rotated once, for example. Further provided inside head 5 is a vertically oriented needle-bar support 27 that supports needle bar 6 as can be seen in FIG. 4. The upper end of needle-bar support 27 is pivoted laterally swingably to a sewing machine frame (not shown). Needle bar support 27 is provided with an upper pivoting section 27*a* and a lower pivoting section 27*b* to support needle bar 6 vertically movably. Needle bar 6 is connected to needle bar driving mechanism 26 through a needle bar clamp 28 shown in FIG. 3 provided substantially at the center of its length running between pivot sections 27*a* and 27*b*.

Yet, further provided inside head 5 is a needle bar swinging mechanism 29 as can be seen in FIG. 4 which laterally swings needle bar support 27 and consequently needle bar 6. Though not described in detail, needle bar swinging mechanism 29 comprises a needle bar swinging step motor 30, a drive gear 31 mounted on the output shaft of needle bar swinging step motor 30, a swing cam 32, and a swing lever 33. Swing cam 32 is provided with a gear 32*a* meshed with drive gear 31. Swing lever 33 driven by swing cam 32 swings needle bar support 27.

Referring back to FIG. 3, the rotation of main shaft 20 is transmitted to lower shaft 21 through a transmission mechanism 34 comprising components such as a pulley and a timing belt. Lower shaft 21 rotates in synchronism in one to one relation with main shaft 20, which means that lower shaft 21 rotates once as main shaft 20 rotates once. Though not shown, the rotation of lower shaft 21 drives the shuttle mechanism and the feed dog driving mechanism. This means that the shuttle mechanism as well as feed dog 10 is driven in synchronism with the vertical movement of needle bar 6. As can be understood from the foregoing, the vertical positioning or the height of needle bar 6 as well as the rotational position and of the shuttle mechanism and the longitudinal and vertical positioning of feed dog 10 are correlated with the rotational phase of main shaft 20.

Referring again to FIG. 3, the present exemplary embodiment provides a main shaft rotational angle detection mechanism 35 at main shaft 20. Main shaft rotational angle detection mechanism 35 indirectly detects the height of needle bar 6 by sensing the rotational phase (angle) of main shaft 20. Main shaft rotational angle detection mechanism 35 is configured by a total of four sensors 40, each comprising a shutter and a photo interrupter. Photo interrupter is provided on the sewing machine frame and optically senses the rotational state of each of shutters 36 to 39. Of note is that three of the four sensors 40 are provided with angular shutters 36, 37, and 38 whereas the remaining sensor is provided with a phase shutter 39.

Each of the angle shutters 36, 37, and 38 is shaped as a disc having a sectoral notch defined on its outer peripheral portion. The notches are each unique in shape and phase. Each of the three sensors 40 uniquely associated with angle shutters 36, 37, and 38 respectively sense their angles which is provided as a reference value for main shaft 20. Phase shutter 39 comprises a thin disc having multiplicity of radial slits 39*a* defined at a predetermined angular interval. Sensor 40 associated with phase shutter 39 keeps track of the count of slits 39*a* passing by it. The count reveals the angle by which slit 39*a* is rotated. The detection signal produced by each sensor 40 is inputted into a later described controller 41 shown in FIG. 10.

Based on the incoming phase (angle) of main shaft 20, controller 41 determines the height of needle bar 6 to stop needle bar 6 at a given height. As later described, controller 41 stops needle bar 6 at three positions namely: an upper position substantially located at the uppermost position, a lower position where sewing needle 7 pierces workpiece cloth W, and a preset position located at a 1 mm elevation from the upper surface of workpiece cloth W immediately before the tip of sewing needle 7 pierces workpiece cloth W. Among the above three positions, the preset position will vary depending upon the thickness of workpiece cloth W. Based on the detection performed by main shaft rotational angle detection mechanism 35, controller 41 is configured to stop needle bar 6 at the upper position when terminating (stopping) the sewing operation.

Figure 5:
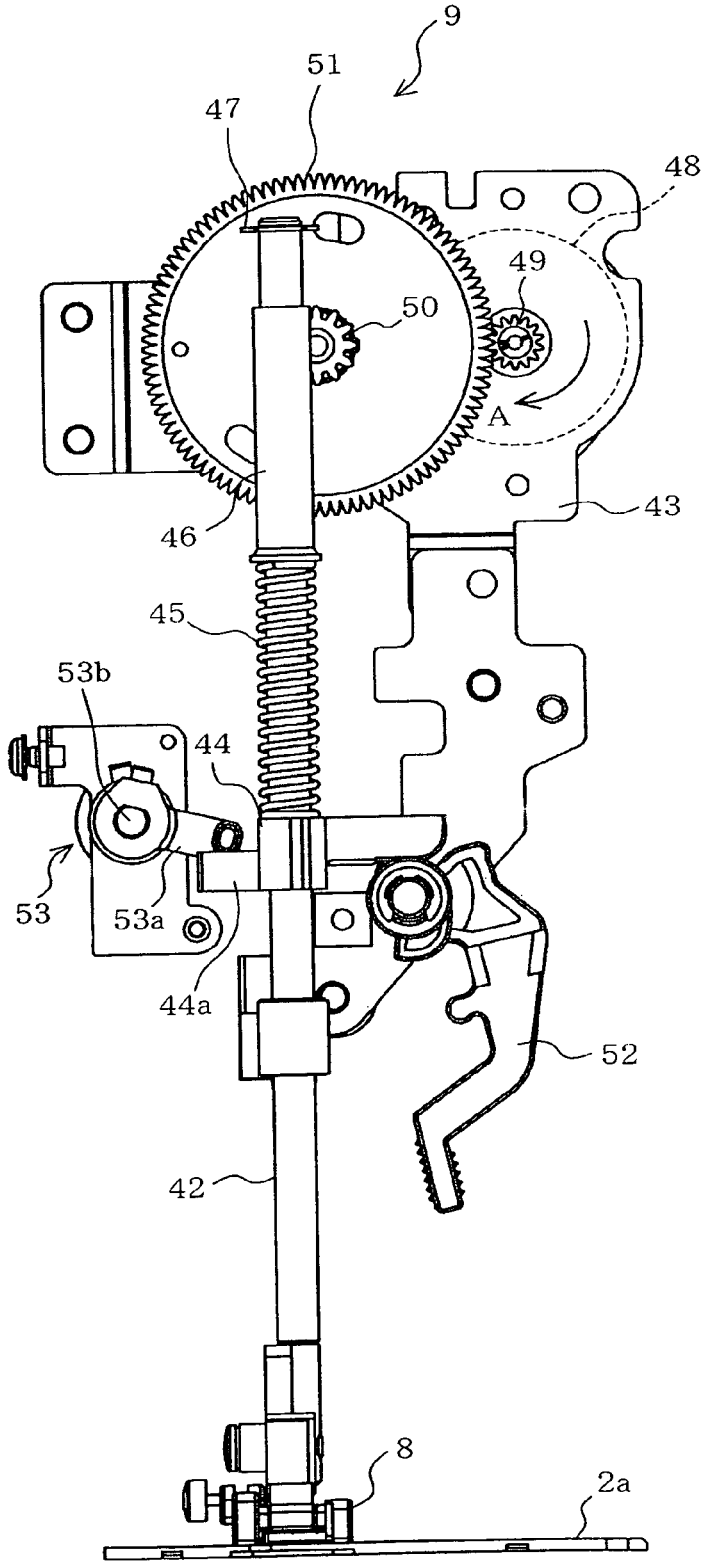
FIG. 5 is a front view of a presser foot vertically moving mechanism with a presser foot in a press position.
Figure 6:
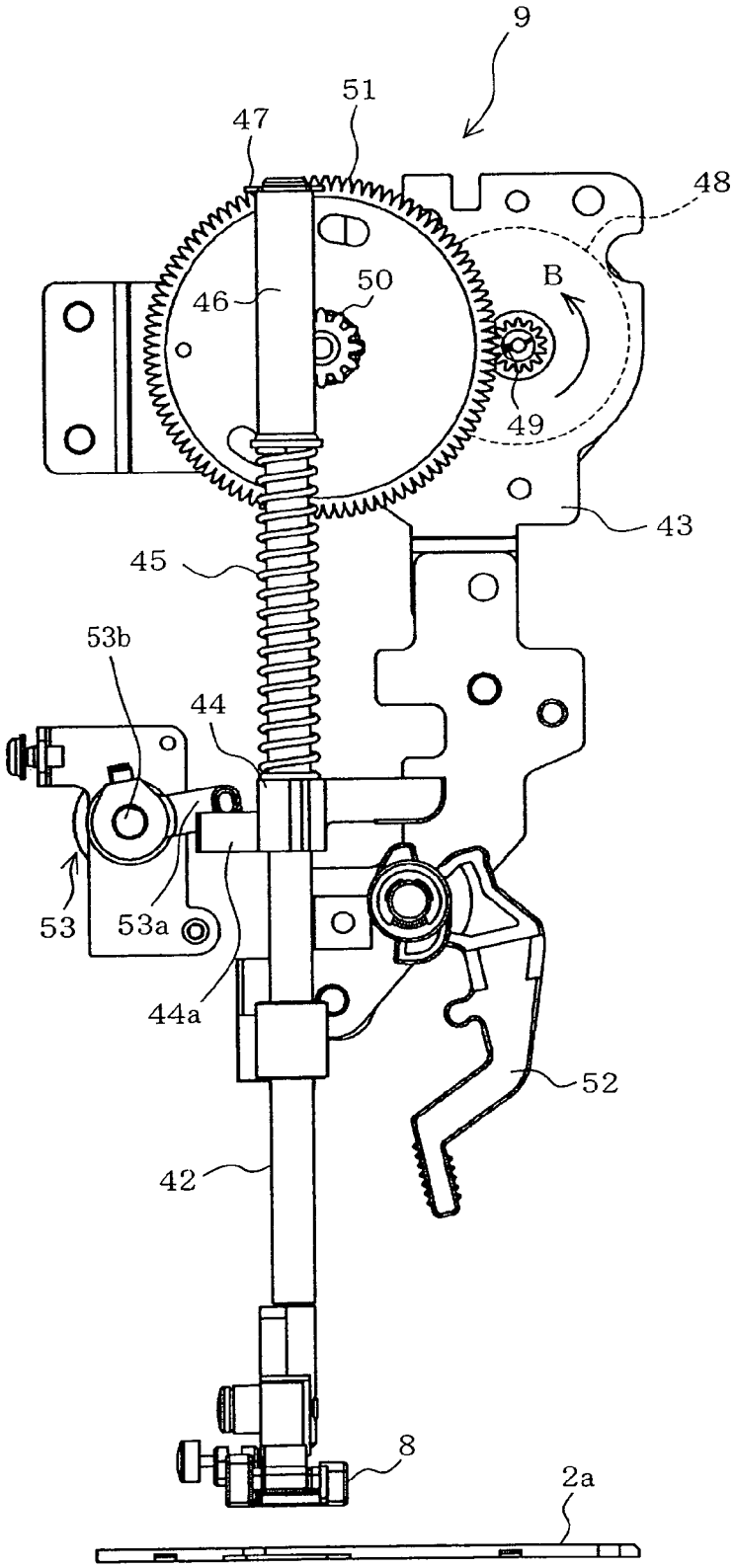
FIG. 6 is a front view of the presser foot vertically moving mechanism with the presser foot in a release position.

FIGS. 5 and 6 provide a front view of a presser bar vertically moving mechanism 9 for vertically moving presser foot 8. Presser foot 8 applies pressure on workpiece cloth W and is mounted on the lower end of vertically elongate presser bar 42. Presser bar 42 is supported vertically movably by a sewing machine frame (not shown) provided inside head 5. Presser bar 42 has a presser bar clamp 44 secured at its vertical mid portion. Presser bar 42 further has a spring 45 comprising a coil spring fitted over it at a portion above needle bar clamp 44 as well as a vertically elongate rack 52 fitted vertically movably over it at a portion above spring 45. Finally, a stop ring 47 is provided at the upper end of presser bar 42.

Yet, further inside head 5, a sewing machine frame is provided that has a mount plate 43 secured on it. On the upper rear side of mount plate 43, a presser bar driving step motor 48 is mounted so as to be oriented forward and a drive gear 54 is mounted on its output shaft so as to be situated on the front side of mount plate 49. On the front face of mount plate 43, a large-diameter intermediate gear 51 being rotated integrally with a coaxial small-diameter pinion 50 is provided such that intermediate gear 51 is in mesh with drive gear 49 and pinion 50 is in mesh with rack 46.

Figures 9A, 9B, 9C:
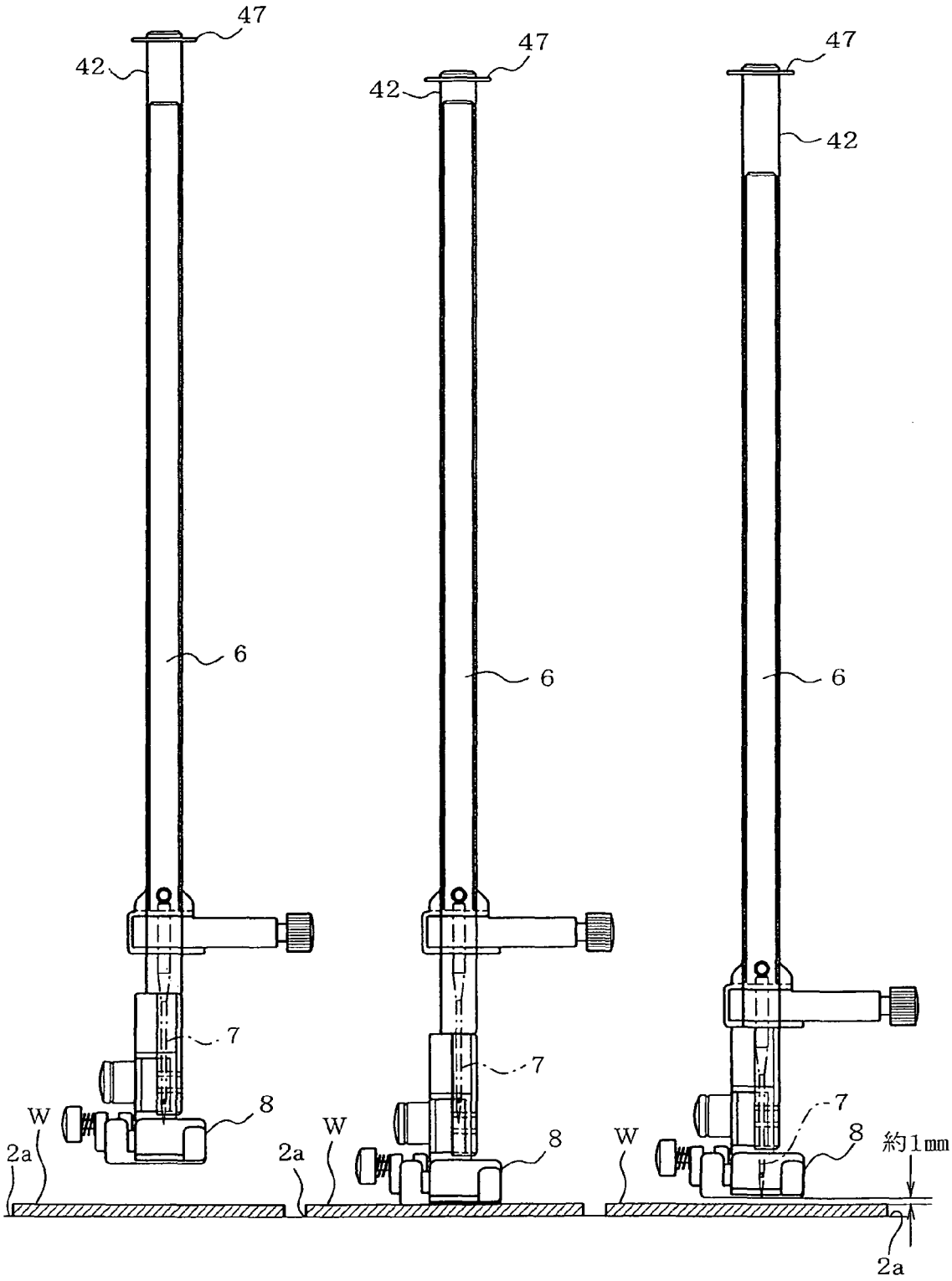
FIG. 9A is a front view of the presser foot in the release position and a needle bar in an upper position.
FIG. 9B is a front view of the presser foot in the press position and the needle bar in a lower position.
FIG. 9C is a front view of the presser foot in the float position and the needle bar in a preset position.

Presser foot vertically moving mechanism 9 vertically moves presser foot 8 (presser bar 42) between a release position, shown in FIGS. 6 and 9A where presser foot 8 is elevated from needle plate 2*a* and press position, as shown in FIGS. 5 and 9B, where presser foot 8 is pressed in contact with the upper surface of workpiece cloth W. Presser foot 8 is also moved, as later described, to a float position, as shown in FIG. 9C, where presser foot 8 is slightly (1 mm for example) elevated from the upper surface of workpiece cloth W. Mount plate 43 is disposed to the right side of presser bar clamp 44 and is provided with a presser bar lifting lever 52 which is manually operated by the user to vertically move presser bar 42 (presser foot 8).

Provided on the left side of presser bar clamp 44 is a height detector 53 for sensing the height of presser bar clamp 44 and consequently presser foot 8. Height detector 53 comprises a potentiometer, for example, and is electrically connected to controller 41. The potentiometer has a rotary shaft 53*b* provided with a lever 53*a* that has its tip biased, by a spring not shown, in consistent abutment with the upper surface of a leftward protrusion 44*a* provided at presser bar clamp 44. Thus, the vertical movement of presser bar clamp 44 causes lever 53*a* to rotate responsively which in turn causes the resistance of the potentiometer to vary depending upon the rotational angle of lever 53*a*. The resistance indicated by height detector 53 at the lowermost height where presser foot 8 is placed in contact with the upper surface of needle plate 2*a* is considered as a reference value. By sensing the variance in resistance from the reference value in the form of a detection signal, the height of presser foot 8, in other words, the thickness of workpiece cloth W can be detected. Presser bar step motor 48 mentioned earlier, is controlled by controller 41 as well.

For instance, when presser foot 8 is located at the release position as shown in FIG. 6 and presser bar driving step motor 48 is driven to rotate drive gear 49 in the direction indicated by arrow A, rack 46 is lowered by pinion 50 as shown in FIG. 5 to lower presser bar 42 and consequently presser foot 8 to the press position contacting workpiece cloth W. The thickness of workpiece cloth W can be determined based on the detection signal provided by height detector 53 under such state. Similarly, when presser bar driving step motor 48 is driven to rotate drive gear 49 in the direction indicated by arrow B, rack 46 is elevated by pinion 50 as shown in FIG. 6 to elevate presser bar 42 and consequently presser foot 8 to the release position.

Referring to FIG. 5, when presser foot 8 is lowered to the press position and presser bar driving step motor 48 is driven in the direction indicated by arrow A to further lower rack 46, presser spring 45 is compressed to increase the pressure applied on workpiece cloth W by presser foot 8 such that degree of compression of presser spring 45, and hence the pressure exerted by it, increases as rack 46 is lowered.

FIGS. 7 to 8 are plan views of a feed dog driving mechanism that drives feed dog 10 to feed the workpiece cloth W and a feed dog switching mechanism 11. Feed dog switching mechanism 11 switches feed dog 10 between an operative state in which feed dog 10 feeds workpiece cloth W by protruding above and retracting below needle plate 2*a* and an inoperative state in which feed dog 10 stays lowered below the upper surface of needle plate 2*a*. Lower shaft 21 described earlier has a vertical feed cam 54 secured to it. Vertical feed cam 54 has an eccentric cam 54*a* on its left end side, and a cylindrical portion 54*b* situated on the right side of cylindrical portion 54*b*.

The feed dog driving mechanism will not be described in detail since it is configured similar to those disclosed in JP 2006-346087 A and JP 2007-244721 A. Feed dog 10 in the operative state is moved above and below needle plate 2*a* in synchronism with the rotation of lower shaft 21 when vertical feed contact 55 is engaged with eccentric cam 54*a* of vertical feed cam 54 as can be seen in FIG. 7. As shown in FIG. 8, on the other hand, when vertical feed contact 55 is shifted rightward from the state described in FIG. 7 to be placed in engagement with cylindrical portion 54*b*, feed dog 10 stays lowered without vertical movement, which means that feed dog 10 is placed in inoperative state below needle plate 2*a*.

Feed dog switching mechanism 11 includes components such as a contact transfer element 56 for laterally transferring vertical feed contact 55, a second slide lever 57 for laterally transferring contact transfer element 56, a swing lever 58 for transferring second slide lever 57, a first slide lever 59 for swinging swing lever 58, a follower gear 60 for transferring first slide lever 59 and a feed dog lowering step motor 61 for driving follower gear 60.

Feed dog 10 along with other components is provided in a feed unit frame 62. On the right side of feed unit frame 62 a drop unit frame 63 is provided that has a feed dog lowering step motor 61, follower gear 60, first slide lever 59 and swing lever 58 mounted on it. Feed dog lowering step motor 61 has a drive gear 64 secured on its drive shaft which is in mesh with follower gear 60. Follower gear 60 has a helical groove cam 60*a* on it which is engaged with an engagement pin 65 provided on the right end of first slide lever 59.

First slide lever 59 being supported laterally slidably has its left end linked to the base end (front end) of swing lever 58. Swing lever 58 extends in the longitudinal direction and is pivoted swingably at its lengthwise mid portion by a pin 66. The front end proximity of swing lever 58 and the rear end proximity of drop unit frame 63 are joined by an extension coil spring 67. The right end of second slide lever 57 is connected to the extreme end of swing lever 58.

As can be seen in FIG. 7, when feed dog lowering step motor 61 is rotated counterclockwise in top view, follower gear 60 is rotated clockwise in top view. First slide lever 59 is moved rightward via engagement pin 65 engaged with helical groove cam 60*a*. This causes swing lever 58 to swing counterclockwise consequently moving contact transfer element 56 leftward via second slide lever 57. Further, vertical feed contact 55 is moved from cylindrical portion 54*b* to eccentric cam 54*a* and feed dog 10 is switched to the operative state in which state feed dog 10 is vertically moved.

As can be seen in FIG. 8, when feed dog lowering step motor 61 is rotated clockwise in top view, follower gear 60 is rotated counterclockwise in top view. First slide lever 59 is moved leftward via engagement pin 65 engaged with helical groove cam 60*a*. This causes swing lever 58 to swing clockwise consequently moving contact transfer element 56 rightward via second slide lever 57. Further, vertical feed contact 55 is moved from eccentric cam 54*a* to cylindrical portion 54*b* and feed dog 10 is switched to the inoperative state in which state feed dog 10 stays lowered and not vertically moved.

FIG. 10 schematically describes an electrical configuration of the sewing machine according to the present exemplary embodiment.

A controller 41 shown in FIG. 10 is configured primarily by a microcomputer and includes components such as a CPU 68, a ROM 69, a RAM 70, an input interface 71 and an output interface 72 which are interconnected by data bus 73, or the like. ROM 69 pre-stores control programs such as a control program for sewing operation control and various data required in sewing operation such as stitch data.

Input interface 71 establishes connections with components such as start/stop switch 13, main shaft rotational angle detection sensors 40, height detectors 53, presser foot vertically moving switch 17, needle height adjustment switch 14, and touch panel 19. Incoming signals from the components listed above are inputted into controller 41. Output interface 72, on the other hand, establishes connections with sewing machine motor 22, presser bar driving step motor 48, feed dog lowering step motor 61, needle bar swinging step motor 30, and LCD 18 through corresponding drive circuits 74 to 78 respectively. Controller 41 is responsible for controlling the components connected to the input and output interfaces 71 and 72.

When start/stop switch 13 is turned on (in this case to instruct start), the sewing operation is started in accordance with the sew mode set either manually by the user or automatically by controlling components such as sewing machine motor 22. In case the free motion mode is set by operation of the mode set key provided on touch panel 19, controller 41 controls presser foot vertically moving mechanism 9 (presser bar driving step motor 48) to move presser foot 8 to the float position shown in FIG. 9C which is slightly above the upper surface of workpiece cloth W by an elevation of 1 mm, for example.

Under such state, the pressure applied on workpiece cloth W by presser foot 8 measures 0 (zero) pressure. When in the free motion mode and the embroidery mode as well, controller 41 further controls feed dog switching mechanism 11

(feed dog lowering step motor 61) to switch feed dog 10 to the inoperative state lowered from the upper surface of needle plate 2*a*.

When presser foot vertically moving switch 17 is turned on, controller 41 controls presser foot vertically moving mechanism 9 (presser bar driving step motor 48) to alternately switch presser foot 8 between the release position and the press position. Further, whenever needle height adjustment switch 14 is operated, controller 41 controls sewing machine motor 22 based on the incoming detection signal from main shaft rotational angle detection mechanism 35 (four detection sensors 40) to switch the position of needle bar 6 between the three positions mentioned earlier in the listed sequence namely: the upper position shown in FIGS. 9A and 9B located substantially at the uppermost position of the vertical movement range, the preset position shown in FIG. 9C located slightly above (at a 1 mm elevation, for example) the upper surface of workpiece cloth W immediately before the tip of sewing needle 7 pierces workpiece cloth W as the result of execution of the later described pre-positioning operation, and the lower position where sewing needle 7 pierces workpiece cloth W.

In the present exemplary embodiment, controller 41 is capable of implementing a pre-positioning control through its software configuration, more specifically through execution of a pre-positioning program as described in the following.

As the first step of the pre-positioning operation, feed dog 10 is switched to the inoperative state through control of feed dog switching mechanism 11 (feed dog lowering step motor 61). Then, presser foot 8 is lowered to the press position to be placed in contact with workpiece cloth W by controlling presser foot vertically moving mechanism 9 (presser bar driving step motor 48). The thickness of workpiece cloth W is detected by the measurement of height at the press position sensed through the detection signals delivered from height detector 53.

Then by controlling presser foot vertically moving mechanism 9 (presser bar driving step motor 48) based on the detection signals delivered from height detector 53, presser foot 8 is stopped at the float position of 1 mm elevation, for example, from the upper surface of workpiece cloth W. At the same time, needle bar 6 is moved to the preset position immediately before the tip of sewing needle 7 pierces workpiece cloth W at an elevation of 1 mm, through control of sewing machine motor 22 based on the detected cloth thickness and the incoming detection signals from main shaft rotational angle detection mechanism 35 comprising four sensors 40.

In the present exemplary embodiment, when the power of main body 1 is turned on and the free motion mode is set by user operation of touch panel 19, controller 41 automatically executes the above described pre-positioning operation. Subsequent operation of start/stop switch 13 starts the free motion sewing operation. Further, when the normal sewing mode is set, controller 41 executes the above described pre-positioning operation by user operation of needle height adjustment switch 14 for moving needle bar 6 to the preset position. Subsequent operation of start/stop switch 13 starts the normal sewing operation.

Next, a description will be given on the operation of the above described configuration with reference to FIGS. 9A to 9C. The flowchart given in FIG. 2 indicates the flow of a pre-positioning operation executed by controller 41 when power of main body 1 is turned on. When power of main body 1 is turned on, needle bar 6 (sewing needle 7) is stopped at the upper position and presser foot 8 assumes the release position where presser foot is elevated. Then, the user places workpiece cloth W on bed 2 (needle plate 2*a*) and sets the free motion mode through touch panel 19 operation if desired. If no mode setting is made at touch panel 19, normal mode is set by default.

Figure 2:
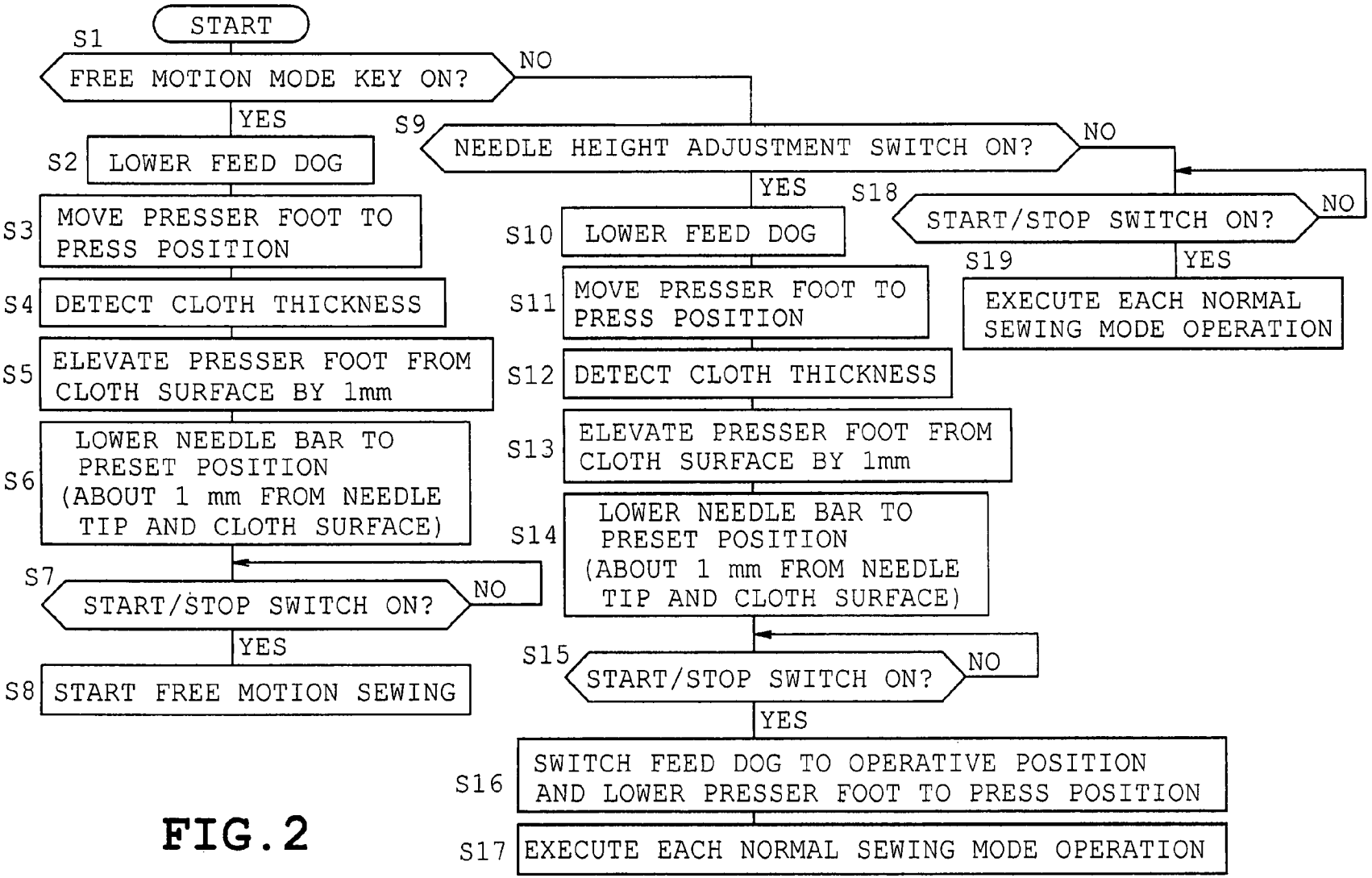
FIG. 2 is a flowchart indicating a flow of a pre-positioning operation executed by a controller.

At step S1 of flowchart given in FIG. 2, a determination is made as to whether or not the free motion mode is set. If free motion mode is set (step S1: Yes), pre-positioning operation is executed in the subsequent steps S2 to S6. More specifically, at step S2, feed dog 10 is switched to the inoperative state through control of feed dog switching mechanism 11 (feed dog lowering step motor 61). Then, at steps S3, presser foot 8 is lowered to the press position where it is placed in contact with the upper surface of workpiece cloth W (refer to FIG. 9B) through the control of presser foot vertically moving mechanism 9 (presser bar driving step motor 48). At step S4, thickness of workpiece cloth W is sensed by incoming detection signals from height detector 53. The thickness of workpiece cloth W can be sensed accurately because feed dog 10 is lowered below needle plate 2*a* at this time.

Then, at step S5, presser foot 8 is lifted to the float position (refer to FIG. 9C) at an elevation of 1 mm, for example, from the upper surface of workpiece cloth W through control of presser foot vertically moving mechanism 9 (presser bar driving step motor 48). At step S6, needle bar 6 is lowered to the preset position through control of sewing machine motor 22, based on the sensed thickness of workpiece cloth W and incoming detection signals from main shaft rotational angle detection mechanism 35 (four detection sensors 40). In the preset position, the tip of sewing needle 7 is located at a height immediately before piercing workpiece cloth W just 1 mm elevated, for example from the upper surface of workpiece cloth W as can be seen in FIG. 9C.

The pre-positioning operation is thus completed and the user is now free to position workpiece cloth W for starting the sewing operation (lining the needle drop point of sewing needle 7 with the starting point of sewing operation on workpiece cloth W). This task is now much more precise and easier for the user since the tip of sewing needle 7 is located immediately above the upper surface of workpiece cloth W. Since the position where the sewing needle 7 (presser foot 6) is stopped (preset position) is determined based on the actual thickness of workpiece cloth W, sewing needle 7 can always be stopped at the most suitable preset position regardless of whether workpiece cloth W is thick or thin.

Workpiece cloth in general are stretchable (elastic) and flexible in nature, and thus is slightly caved when depressed by presser foot 8. Hence, after thickness sensing of workpiece cloth W, even when presser foot 8 is moved to the float position floating 1 mm above the upper surface of the depressed workpiece cloth W to release the pressure applied on it, the upper surface of workpiece cloth W still maintains its closeness to the underside of presser foot 8 so as to be in substantial contact with it. This is especially true in free motion sewing, where a quilting fabric comprising a top cloth, a bottom cloth and batting such as cotton and wool stuffed between the top and bottom cloth is manually moved to sew decorative patterns. Since the batting material such as cotton and wool are stretchable (elastic), the upper surface of workpiece cloth W or the top cloth is moved in substantial sliding contact with the underside of presser foot 8 when positioning workpiece cloth W at the start of sewing operation. Such sliding contact exerts regulatory force against workpiece cloth W displacement to free the user from having to provide too much manual support during workpiece cloth W positioning, which makes the work much easier for the user. Moreover, since feed dog 10 is placed in inoperative state during the positioning work, the user is allowed to move workpiece cloth W smoothly without interference of feed dog 10

After positioning workpiece cloth W, start/stop switch 13 is turned on by the user (step S7: Yes) to start free motion sewing at step 8. Free motion sewing is performed by needle bar 6 (and the shuttle mechanism) being driven by sewing machine motor 22. During this time, presser foot 8 is maintained at the floating position and feed dog 10 is maintained at the inoperative state.

If the user has selected the normal mode which means that no other modes were selected through touch panel 19 (step S1: No), needle height adjustment switch 14 may be operated to instruct transfer of needle bar 6 (sewing needle 7) to the preset position on a required basis to execute the above described pre-positioning operation. In other words, when needle height adjustment switch 14 is operated (step S9: Yes) in the normal mode, subsequent steps S10 to S14 execute the pre-positioning operation executed in the above described steps S2 to S6.

Execution of the pre-positioning operation places feed dog 10 in the inoperative state. Further, as can be seen in FIG. 9C, presser foot 8 is placed in the float position at a 1 mm elevation from the upper surface of workpiece cloth W while needle bar 6 is lowered to the preset position such that the tip of sewing needle 7 is placed at a height immediately before piercing workpiece cloth W. The above arrangement facilitates and improves the preciseness of the user's positioning of workpiece cloth W for starting the sewing operation.

Then, when the user turns on start/stop switch 13 (step S15: Yes), feed dog 10 is switched to the operative state through control of feed dog switching mechanism 11 (feed dog lowering step motor 61) at step S16 before staring the sewing operation. At the same time, presser foot 8 is lowered to the press position through control of presser foot vertically moving mechanism 9 (presser bar driving step motor 48). Sewing operation under the normal mode is executed thereafter at step S17.

If the user does not require the above described pre-positioning operation, the user may proceed to turning on start/stop switch 13 (step S18: Yes) without operating needle height adjustment switch 14 (step S9: No). Then, at step S19, sewing operation under the normal mode is executed. Another possible sewing mode not described in the present disclosure is an embroidery mode in which embroidering is performed with an attachment of an embroidery frame, holding workpiece cloth W, to embroidery machine 12. Since no user intervention is required in positioning workpiece cloth W as compared to the above described modes, pre-positioning operation will not be required as well.

According to the above described exemplary embodiment, the pre-positioning operation, executed prior to the user's manual positioning work in starting the sewing sequence, stops sewing needle 7 at a preset position immediately before piercing workpiece cloth W. Further, pressure exerted on workpiece cloth W by presser foot 8 is adjusted at a predetermined pressure (zero, in the above described exemplary embodiment) to allow movement of workpiece cloth W. Yet further, feed dog 10 is placed in the inoperative state. According to the above described arrangement, the user is no longer required to perform a troublesome preparatory task of manually moving needle bar 6 through rotation of hand pulley 25. Furthermore, movement of workpiece cloth W can be controlled so that it is neither moved excessively nor prevented from moving by the interference of feed dog 10, thus advantageously allowing easier and more reliable workpiece cloth W positioning.

In executing free motion sewing that requires positioning of workpiece cloth W prior to the sewing operation, the present exemplary embodiment is configured to automatically execute the pre-positioning operation in response to the setting of free motion sewing mode. Since the user is no longer required to operate any switches etc., to initiate the positioning work, the user may proceed more smoothly with the free motion sewing operation. The user is also allowed to execute the pre-positioning operation even in the normal mode by operating needle height adjustment switch 14 to provide more flexibility and user friendliness. Since this feature is rendered by utilizing needle height adjustment switch 14, no separate switch needs to be added which is advantageous in providing a simple and low cost configuration.

Pre-positioning operation is executed in the present exemplary embodiment such that it is executed automatically in the free motion mode and manually by user depression of needle height adjustment switch 14 in the normal sewing mode. Alternatively, a separate, dedicated switch (including another switch provided on touch panel) apart from needle height adjustment switch 14 may be provided as a dedicated operation element for allowing the user to instruct execution of the pre-positioning operation. Under such configuration, pre-positioning operation may be executed only upon operation of the dedicated switch irrespective of the sew mode. Yet, alternatively, pre-positioning operation may be executed only when free motion mode has been selected without providing any switch (operation element).

In the pre-positioning operation, the present exemplary embodiment places presser foot 8 at the floating position at 1 mm elevation from the upper surface of workpiece W and adjusts the pressure applied on workpiece cloth W at zero. The elevation of the float position from the upper surface of workpiece cloth w is not limited to 1 mm but may be adjusted as required. Further, pressure applied on workpiece cloth W may be adjusted at a magnitude of 10*g* to 20*g* for example, which would allow the user to move workpiece cloth W smoothly by pulling it back and forth and to the left and right without elevating presser foot 8. The elevation of the preset position of needle bar 6 is not limited to 1 mm but may be configured such that the tip of sewing needle 7 is placed about 5 mm above the upper surface of the workpiece cloth W. What is intended is that any adjustment may be made to provide favorable conditions for the user in positioning workpiece cloth W.

Though, the above described exemplary embodiment was based upon a sewing machine which allows attachment of embroidery machine 12, in other words, an embroiderable sewing machine, the present disclosure may of course be applied to a sewing machine with does not allow attachment of embroidery machine 12. Various other modifications may be made to the configuration of presser foot vertically moving mechanism 9, feed dog switching mechanism 11, main shaft rotational angle detection mechanism 35, and height detector 53.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a needle bar;

a sewing needle attached to a lower end of the needle bar;

a needle bar driving mechanism that vertically moves the needle bar and that allows the needle bar to be stopped at a given position;

a needle bar position detection mechanism that detects a vertical position of the needle bar;

a bed;

a needle plate provided on the bed;

a presser foot that presses a workpiece cloth against the needle plate;

a pressure adjustment mechanism that adjusts a pressure exerted by the presser foot;

a thickness detection mechanism that detects a thickness of the workpiece cloth;

a feed dog that feeds the workpiece cloth;

a feed dog switching mechanism that switches the feed dog between an operative state in which the feed dog is moved above and below the needle plate and an inoperative state in which the feed dog stays below the needle plate;

a controller that controls the needle bar driving mechanism, the pressure adjustment mechanism, and the feed dog switching mechanism, wherein the controller is configured to be capable of executing a pre-positioning operation including:

controlling the needle bar driving mechanism, based on the thickness of the workpiece cloth detected by the thickness detection mechanism and the vertical position of the needle bar detected by the needle bar position detection mechanism, to stop the needle bar at a preset position immediately before a tip of the sewing needle pierces the workpiece cloth, controlling the pressure adjustment mechanism to adjust the pressure of the presser foot at a predetermined pressure that allows movement of the workpiece cloth, and controlling the feed dog switching mechanism to switch the feed dog to the inoperative state.

2. The sewing machine according to claim 1, further comprising an operation element that instructs the pre-positioning operation executed by the controller.

3. The sewing machine according to claim 2, wherein the operation element comprises a needle height adjustment switch that switches the vertical position of the needle bar, and wherein the controller, whenever the needle height adjustment switch is operated, controls the needle bar driving mechanism to switch the vertical position of the needle bar in a listed sequence of an upper position where the sewing needle is elevated, the preset position rendered by the pre-positioning control, and a lower position where the sewing needle pierces the workpiece cloth.

4. The sewing machine according to claim 1, wherein a free motion mode can be set that allows the workpiece cloth to be manually moved in forming stitches, the setting of the free motion mode triggering automatic execution of the pre-positioning operation.

5. The sewing machine according to claim 1, further comprising a presser bar that supports the presser foot, wherein the thickness detection mechanism includes a detector that detects a height of the presser bar when the presser foot is placed in contact with an upper surface of the workpiece cloth and wherein the controller controls the feed dog switching mechanism to switch the feed dog to the inoperative state when detecting the thickness of the workpiece cloth by the detector.

* * * * *